US009370940B1

(12) United States Patent
LeFevre et al.

(10) Patent No.: US 9,370,940 B1
(45) Date of Patent: Jun. 21, 2016

(54) SINGLE DECURLER CONFIGURATION FOR REDUCED CONTAMINATION OF DECURLER

(71) Applicant: Xerox Corporation, Norwalk, CT (US)

(72) Inventors: Jason Matthew LeFevre, Penfield, NY (US); Michael Jon Levy, Webster, NY (US); David Alan VanKouwenberg, Avon, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/849,817

(22) Filed: Sep. 10, 2015

(51) Int. Cl.
*B41J 29/393* (2006.01)
*B41J 11/00* (2006.01)

(52) U.S. Cl.
CPC ..... *B41J 11/0005* (2013.01)

(58) Field of Classification Search
None
See application file for complete search history.

(56) References Cited

U.S. PATENT DOCUMENTS 6,259,884 B1 * 7/2001 Oberhoffner ..... G03G 15/238 101/211
8,523,347 B2 * 9/2013 Satoh ..... B65H 29/60 347/101
8,696,104 B1 * 4/2014 de Jong ..... G03G 15/24 347/103

* cited by examiner

*Primary Examiner* — Lamson Nguyen

(57) ABSTRACT

A method, non-transitory computer readable medium and apparatus for reducing contamination on a decurler in a printer are disclosed. For example, the method includes printing, by a marking engine, an image on a paper on a first side, inverting, by a first inverter, the paper so that the image on the first side is facing in an opposite direction than when passing through the marking engine and decurling, by the de-curler, the paper such that the image on the first side contacts a soft roller of the upstream de-curler.

20 Claims, 5 Drawing Sheets

SINGLE DECURLER CONFIGURATION FOR REDUCED CONTAMINATION OF DECURLER

The present disclosure relates generally to reducing downtime of a multi-function device and, more particularly, to a method and apparatus for a single decurler configuration for reduced contamination of the decurler.

BACKGROUND

Current next generation printers may have strict output specification limits for an amount of curl that can be allowed for each image printed onto a paper. For example, excessive curl may affect how printed sheets are delivered to an in-line stacker.

Current next generation printers use an upstream decurler and a downstream decurler to control the amount of curl. However, the current configuration of the upstream decurler and the downstream decurler causes excessive ink buildup on the decurlers. As a result, the printers may experience excessive or unacceptable amounts of down time for maintenance to clean the decurlers and remove the ink buildup. The excess ink buildup may also cause contamination of the image (e.g., streaks, smearing, and the like).

SUMMARY

According to aspects illustrated herein, there are provided a method, non-transitory computer readable medium and apparatus for reducing contamination on a decurler in a printer. One disclosed feature of the embodiments is a method that prints, by a marking engine, an image on a paper on a first side, inverts, by a first inverter, the paper so that the image on the first side is facing in an opposite direction than when passing through the marking engine and decurls, by the decurler, the paper such that the image on the first side contacts a soft roller of the upstream de-curler.

Another disclosed feature of the embodiments is a non-transitory computer-readable medium having stored thereon a plurality of instructions, the plurality of instructions including instructions which, when executed by a processor, cause the processor to perform operations that cause a marking engine to print an image on a paper on a first side, cause a first inverter to invert the paper so that the image on the first side is facing in an opposite direction than when passing through the marking engine and cause the decurler to decurl the paper such that the image on the first side contacts a soft roller of the upstream de-curler.

Another disclosed feature of the embodiments is an inkjet printer comprising a marking path comprising a registration, a marker and a dryer, a first transport path located after the marking path, a pre-inverter located after the marking path and the first transport path to invert a paper so that a most recently printed image on a respective side of a paper is facing in an opposite direction than when passing through the marking engine, a single decurler located after the pre-inverter comprising a rubber roller and a stainless steel roller, wherein the most recently printed image on the respective side of the paper contacts the rubber roller and does not contact the stainless steel roller, at least one second transport path located after the single decurler and a paper tray located after the at least one second transport path.

BRIEF DESCRIPTION OF THE DRAWINGS

The teaching of the present disclosure can be readily understood by considering the following detailed description in conjunction with the accompanying drawings, in which.

To facilitate understanding, identical reference numerals have been used, where possible, to designate identical elements that are common to the figures.

DETAILED DESCRIPTION

The present disclosure broadly discloses a method and apparatus for reducing contamination on a decurler in a printer. As discussed above, current next generation printers may have strict output specification limits for an amount of curl that can be allowed for each image printed onto a paper. For example, excessive curl may affect how printed sheets are delivered to an in-line stacker.

Current next generation printers use an upstream decurler and a downstream decurler to control the amount of curl. However, the current configuration of the upstream decurler and the downstream decurler causes excessive ink buildup on the decurlers. As a result, the printers may experience excessive or unacceptable amounts of down time for maintenance to clean the decurlers and remove the ink buildup. The excess ink buildup may also cause contamination of the image (e.g., streaks, smearing, and the like).

Embodiments of the present disclosure provide a method and apparatus for reducing contamination on a decurler in a printer. In one embodiment, the multiple decurlers in the printer (e.g., the upstream decurler and the downstream curler) are reduced to a single decurler (e.g., only using an upstream decurler) by using a pre-inverter. As a result, the number of possible hard rollers being contaminated is reduced.

In addition, the pre-inverter inverts the paper after leaving the marking path such that the most recently printed image on a respective side does not contact the hard roller of the single decurler. Rather, the image is inverted such that the most recently printed image only contacts the soft roller of the single decurler.

For example, in a simplex path the image may be printed on a first side of the paper. The pre-inverter may invert the paper such that the image that is printed on the first side of the paper faces in an opposite direction (e.g., down instead of up) than when the paper traveled through the marking path. As a result, the image faces "down" and contacts the soft roller of the single decurler rather than the hard roller of the single decurler.

Figure 1:
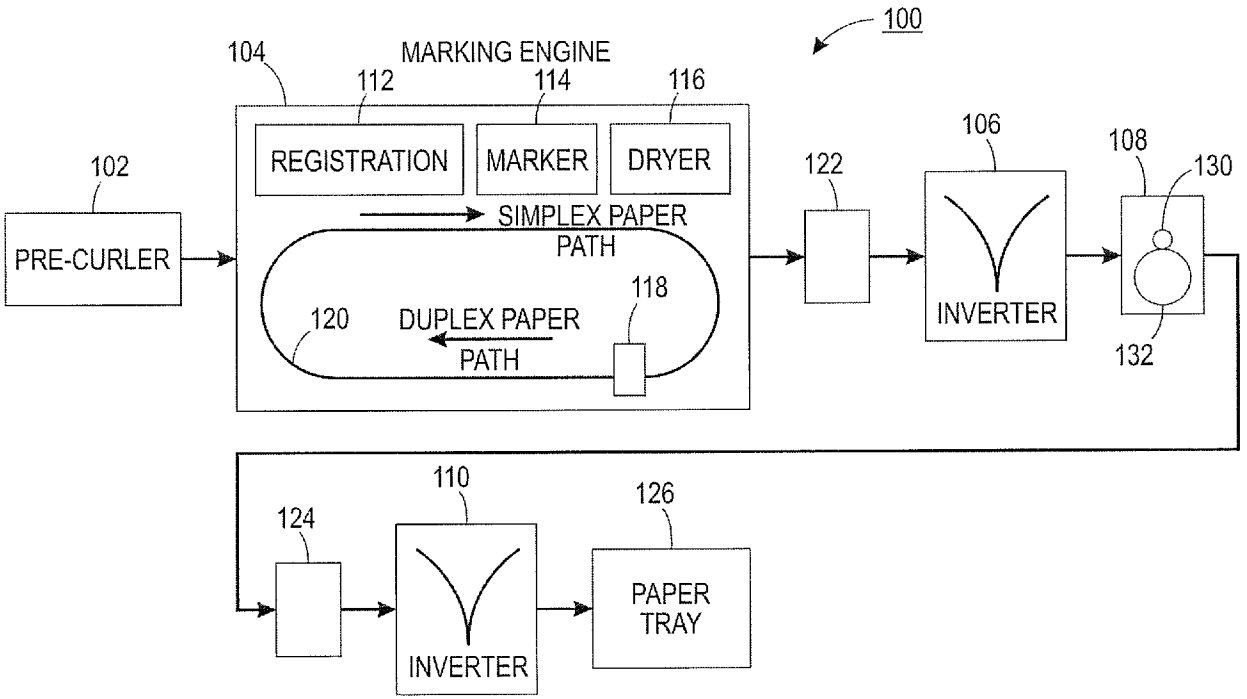
FIG. 1 illustrates an example block diagram of an example printer of the present disclosure.

FIG. 1 illustrates an example printer 100 of the present disclosure. In one embodiment, the printer 100 may be an ink jet printer that prints images using a water based ink. As noted above, when a thick image (e.g., a length in a process direction of 2 inches or greater) is printed on a lead edge front (LEF) the image can contaminate the hard roller of a decurler. The embodiments of the present disclosure provide a new paper path for the printer 100 to reduce contamination of the hard roller of the decurler while meeting the curl requirements for stacking paper.

In one embodiment, the printer 100 includes a pre-curler 102, a marking engine 104, a first inverter 106 (also referred to as a pre-inverter), a decurler 108, a second inverter 110

(also referred to as post-inverter), a paper tray 126 and one or more transport paths 122 and 124. In one embodiment, one or more transport paths 122 may be located between the marking engine 104 and the first inverter 106 and one or more transport paths 124 may be located between the decurler 108 and the second inverter 110. The one or more transport paths may be a nip transport.

In one embodiment, the marking engine 104 may include a registration module 112, a marker 114, a dryer 116, a duplex decurler 118 and a loop 120 for a duplex paper path. In one embodiment, the registration module 112 may be used for registering a sheet as it is introduced to the marking transport belt. The registration module 112 may affect sheet alignment and skew relative to the marked image as a whole. In one embodiment, the marker 114 may perform the actual printing of the image using a water based ink. In one embodiment, the dryer 116 may dry the image that is printed via a heat source or using air.

In one embodiment, a paper may go through the marking engine 104 in a single pass for a simplex paper path. For a double sided print job, the paper may go through the marking engine 104 a second time via the duplex decurler 118, a duplex inverter to flip the paper (not shown) and the loop 120. The paper may be flipped and a different image may be printed on the opposite side, or second side, of the paper.

In one embodiment, the pre-curler 102 may be located before the marking engine 104. The pre-curler 102 may apply an up curl to the paper to counter act a down curl of the paper induced by the image that is printed on the paper.

In one embodiment, the inverter 106 may be added to the print path with a single decurler 108 to reduce the amount of contamination on a hard roller 130 of the decurler 108. Notably, the printer 100 does not include any other decurlers after the marking engine 104. Rather only a single decurler 108 is deployed in the printer 100 after the marking engine 104.

In one embodiment, the hard roller 130 may be fabricated from a metal, such as stainless steel. As noted above, current printers do not include the inverter 106 and include multiple decurlers (e.g., an upstream decurler and a downstream decurler). However, the hard roller 130 of the decurlers is often contaminated by the ink used to print the image on the paper.

However, it is recognized that a soft roller 132 is less susceptible to ink contamination. In one embodiment, the soft roller 132 may be fabricated from rubber. By adding the inverter 106, the paper is flipped or inverted such that the most recently printed image does not contact the hard roller 130. Rather, the most recently printed image contacts the soft roller 132.

For example, for a single sided simplex print job, the most recently printed image would be the image printed on the first side. The paper may go through the marking engine 104 with a first side of the paper that is printed on facing upwards. The paper would be inverted by the inverter 106 such that the first side of the paper is now flipped to face downward, or in an opposite direction than when passing through the marking engine 104.

As a result, when the paper passes through the decurler 108, the first side of the paper with the printed image would only contact the soft roller 132. The image would not contact the hard roller 130.

For a double sided duplex print job, the most recently printed image would be the second image printed on a second side of the paper. The paper would go through the marking engine 104 with the second side of the paper that is printed facing upwards for the double sided duplex print job. The inverter would flip or invert the paper such that the second image would face downward or in an opposite direction than when passing through the marking engine 104.

As a result, when the paper passes through the decurler 108, the second side of the paper with the most recently printed image would only contact the soft roller 132 and not the hard roller 130. The first side with the first printed image would contact the hard roller 130. However, the first printed image would have passed through the dryer 116 twice and presumably dried sufficiently to not contaminate the hard roller 130 with ink.

In other words, the hard roller 130 does not contact an image printed with the water based ink that has not passed through the dryer 116 at least twice. Alternatively, for single sided print jobs, the hard roller 130 would never contact the image printed with the water based ink. Only the soft roller 132 would contact the image.

In addition, by removing an additional decurler, there are fewer components that can be contaminated. As a result, the printer may have longer run times between maintenance and fewer components may need to be cleaned.

In one embodiment, the second inverter 110 may be used to invert the paper again depending on whether the paper is stacked in a 1–N order or an N–1 order. The paper may then be outputted to the paper tray 126.

Figure 2:
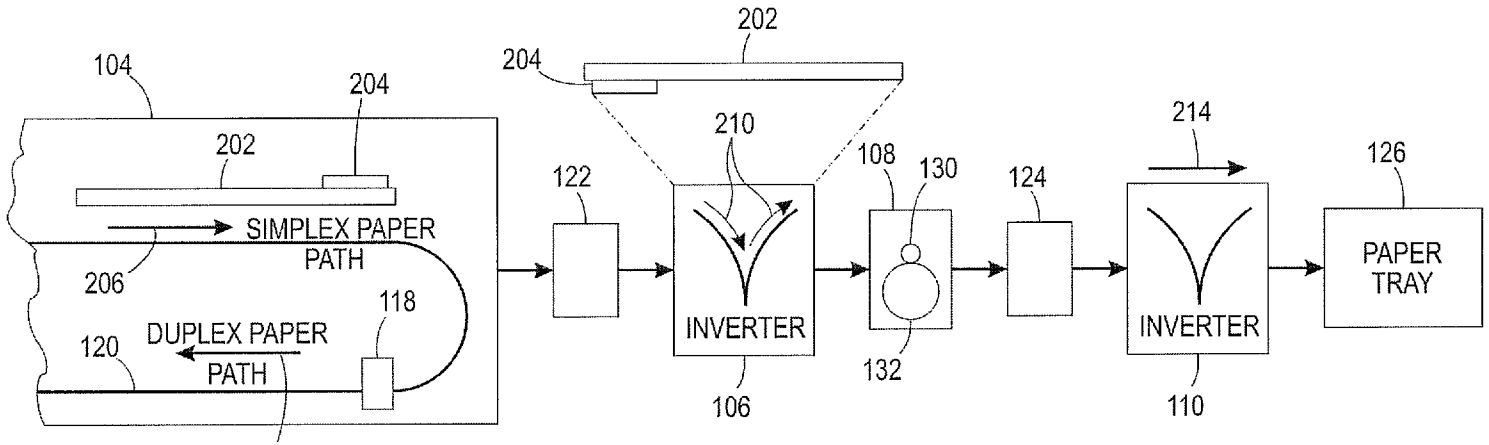
FIG. 2 illustrates an example block diagram of a simplex and duplex path for a 1–N order.

FIG. 2 illustrates an example block diagram of a simplex and duplex path for a 1–N order. FIG. 2 illustrates a paper 202 having an ink 204 applied to a side of the paper to print an image. In one embodiment, the image may be printed in a thick block towards a front leading edge of the paper. In one embodiment, "thick" may be defined as a block or image that is two inches or greater in length in a process direction.

For a simplex paper path, the paper 202 may have the image printed on a first side of the paper as shown by arrow 206. The paper 202 may then be moved by the transport 122 to the first inverter 106. The first inverter 106 may flip or invert the paper 202 as shown by arrows 210. The paper 202 is shown flipped above the inverter 106 in FIG. 2. After passing through the first inverter 106, the ink 204 is now facing in an opposite direction than when the paper passed through the marking engine 104. In addition, the lead edge and the trail edge of the paper also flips after the first inverter 106. Said another way, the first side of the paper 202 was facing upwards through the marking engine 104. After passing through the first inverter 106, the first side having the ink 204 used to print the image is facing downwards. In addition, what was the lead edge has now become the trail edge.

The paper 202 passes through the decurler 108. Notably, the first side having the ink 204 used to print the image contacts only the soft roller 132. The first side having the ink 204 used to print the image does not contact the hard roller 130. As a result, no ink may directly contaminate the hard roller 130.

The paper 202 passes through one or more transports 124 and skips the second inverter 110. Arrow 214 illustrates the paper path moving over the second inverter 110 to illustrate that the paper 202 does not pass through the second inverter 110. The paper 202 then is outputted to the paper tray 126.

For a duplex paper path, the paper 202 may be flipped and pass through the marking engine 104 a second time as shown by arrow 208. After the second image is printed on the second side of the paper 202, the paper 202 would follow the same path as described above for the simplex path. However, for the duplex paper path, the first side having the first image that was printed will have passed through the dryer 116 of the marking engine 104 twice. As a result, when the first side having the first image contacts the hard roller 130 in the decurler 108, no ink contamination will occur since the ink 204 will have been sufficiently dried. In other words, the second image printed on the second side (e.g., the most recently printed image) will be the side that contacts the soft roller 132 of the decurler 108 to minimize or eliminate the ink contamination on the hard roller 130.

Figure 3:
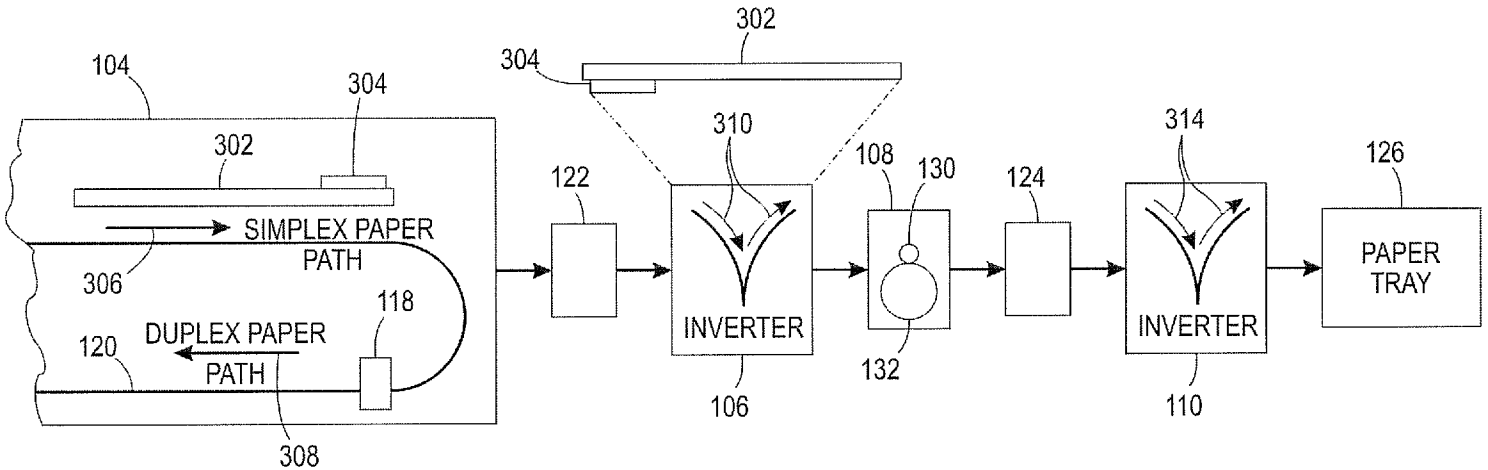
FIG. 3 illustrates an example block diagram of a simplex and duplex path for an N–1 order.

FIG. 3 illustrates an example block diagram of a simplex and duplex path for an N−1 order. FIG. 3 illustrates a paper 302 having an ink 304 applied to a side of the paper to print an image. In one embodiment, the image may be printed in a thick block towards a front leading edge of the paper. In one embodiment, "thick" may be defined as a block two inches or greater.

For a simplex paper path, the paper 302 may have the image printed on a first side of the paper as shown by arrow 306. The paper 302 may then be moved by the transport 122 to the first inverter 106. The first inverter 106 may flip or invert the paper 302 as shown by arrows 310. The paper 302 is shown flipped above the inverter 106 in FIG. 2. After passing through the first inverter 106, the ink 304 is now facing in an opposite direction than when the paper passed through the marking engine 104. Said another way, the first side of the paper 302 was facing upwards through the marking engine 104. After passing through the first inverter 106, the first side having the ink 304 used to print the image is facing downwards.

The paper 302 passes through the decurler 108. Notably, the first side having the ink 304 used to print the image contacts only the soft roller 132. The first side having the ink 304 used to print the image does not contact the hard roller 130. As a result, no ink may directly contaminate the hard roller 130.

The paper 302 passes through one or more transports 124 and enters the second inverter 110 to be flipped or inverted. Arrows 314 illustrate the paper path moving into the second inverter 110 to illustrate that the paper 302 passes through the second inverter 110. The paper 302 then is outputted to the paper tray.

For a duplex paper path, the paper 302 may be flipped and pass through the marking engine 104 a second time as shown by arrow 308. After the second image is printed on the second side of the paper 302, the paper 302 would follow the same path as described above for the simplex path. However, for the duplex paper path, the first side having the first image that was printed will have passed through the dryer 116 of the marking engine 104 twice. As a result, when the first side having the first image contacts the hard roller 130 in the decurler 108, no ink contamination will occur since the ink 304 will have been sufficiently dried. In other words, the second image printed on the second side (e.g., the most recently printed image) will be the side that contacts the soft roller 132 of the decurler 108 to minimize or eliminate the ink contamination on the hard roller 130.

Figure 4:
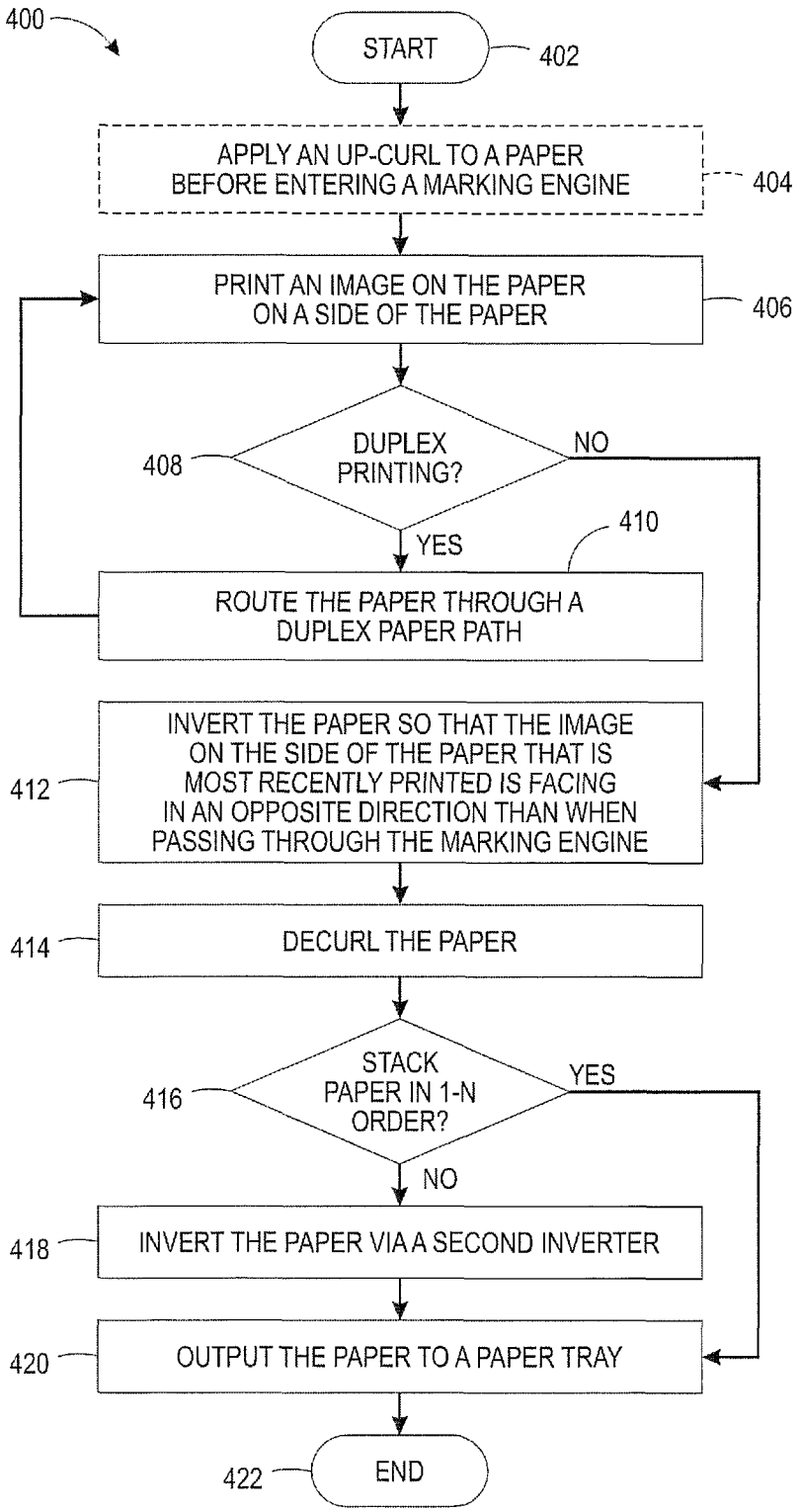
FIG. 4 illustrates an example flowchart of a method for reducing contamination on a decurler in a printer.

FIG. 4 illustrates a flowchart of a method 400 for reducing contamination on a decurler in a printer. In one embodiment, one or more steps, or operations, of the method 400 may be performed by the printer 100 or a computer as illustrated in FIG. 4 and discussed below.

At block 402 the method 400 begins. At optional block 404, the method 400 applies an up-curl to a paper before entering a marking engine. For example, a pre-curler may be located before the marking engine to add an up-curl to counter act the down curl induced by the water based ink applied to the paper when printing an image.

At block 406, the method 400 prints an image on the paper on a side of the paper. In one embodiment, the image may be printed on a first side of the paper. In another embodiment, when a duplex paper path is used, a second image may be printed on a second side, or opposite side, of the paper.

In one embodiment, a marking engine may be used to print the image with a water based ink. For example, the marking engine may have a registration module, a marker and a dryer. The paper may pass through the registration module, the marker to have the image printed on the side of the paper (e.g., the first side or second side) and the dryer to dry the water based ink.

At block 408, the method 400 determines if a duplex printing is required. In one embodiment, duplex printing may be used to print on both sides of the paper or media. If the answer to block 408 is yes, the method may proceed to block 410.

At block 410, the method 400 routes the paper through a duplex paper path. For example, the paper may be flipped, de-curled and routed back through marking engine. The method 400 may then return to step 406 to print the image on the side of the paper (e.g., a different image on the second side, or the opposite side, of the paper).

Returning to block 408, if the answer to block 408 is no, the method may proceed to block 412. For example, duplex printing may not be required, or paper has already gone through the duplex paper path and the duplex printing has been completed.

At block 412, the method 400 inverts the paper so that the image on the side of the paper that is most recently printed is facing in an opposite direction than when passing through the marking engine. For example, if a simplex paper path (e.g., single sided print job) is used, then the most recently printed image may be the image that was printed on the first side of the paper. The first side of the paper may be facing in a first direction or in an upward direction when passing through the marking engine. The inverter would then invert the paper so that the first side of the paper is now facing in an opposite direction (e.g., in a second direction or in a downward direction).

In another example, if a duplex paper path (e.g., a double sided print job) is used, then the most recently printed image may be the second image that was printed on the second side of the paper. The inverter would invert the paper so that the second side of the paper that was facing in an upward direction when passing through the marking engine, faces in an opposite direction, or a downward direction.

At block 414, the method 400 decurls the paper. For example, only a single decurler is required for the newly designed paper path. In addition, the most recently printed image contacts a soft roller or rubber roller of the decurler and does not contact the hard roller of the decurler.

For duplex print jobs, the image that was printed first may contact the hard roller in the decurler. However, the image that was printed first would have passed through the dryer in the marking engine twice. Thus, the image that was printed first would have enough residency time in the dryer to ensure that the water based ink used to print the first image would not contaminate the hard roller of the decurler.

At block 416, the method 400 determines if the paper should be stacked in a 1−N order. For example, depending on the way the paper is collated for a print job, the paper may be stacked in a 1−N order or an N−1 order. If the answer to block 416 is no, the method 400 may proceed to block 418. In other words, the paper is to be stacked in an N−1 order.

At block 418, the method 400 inverts the paper via second inverter. For example, the second inverter may be a post-inverter that is used to invert the paper so that the most recently printed image is facing in an original direction as when passing through the marking engine. For example, for a simplex print path, the image on the first side would be inverted from facing downward to facing in the original direction upward for the N−1 order.

Returning to block 416, if the answer to block 416 is yes, then the method 400 may proceed to step 420. In other words, the paper is to be stacked in a 1–N order and does not need to be inverted via the post-inverter.

At block 420, the method 400 outputs the paper to the paper tray. At block 422 the method 400 ends.

It should be noted that although not explicitly specified, one or more steps, functions, or operations of the method 400 described above may include a storing, displaying and/or outputting step as required for a particular application. In other words, any data, records, fields, and/or intermediate results discussed in the methods can be stored, displayed, and/or outputted to another device as required for a particular application. Furthermore, steps, functions, or operations in FIG. 4 that recite a determining operation, or involve a decision, do not necessarily require that both branches of the determining operation be practiced. In other words, one of the branches of the determining operation can be deemed as an optional step.

As a result, the embodiments of the present disclosure improve the functioning of a printer. For example, the printer may be reconfigured to reduce contamination on a decurler in a printer. Notably, the present disclosure provides an improvement in the technological arts of printers.

Figure 5:
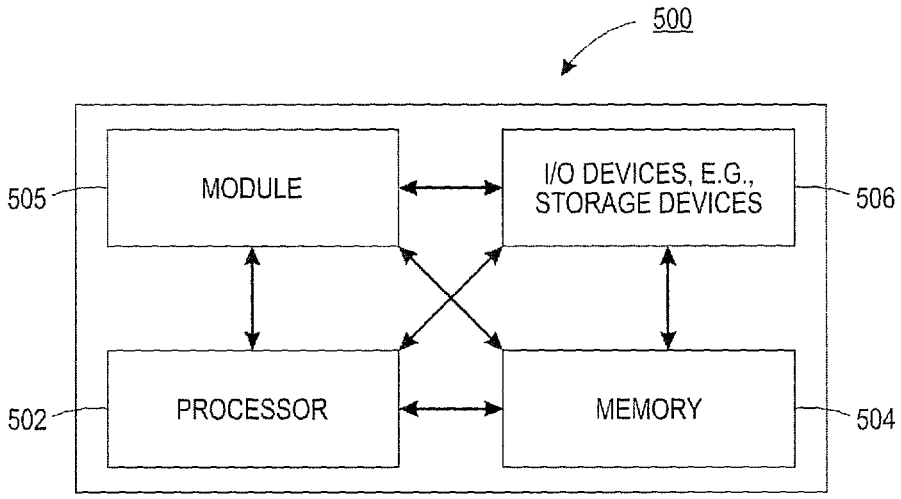
FIG. 5 illustrates a high-level block diagram of a computer suitable for use in performing the functions described herein.

FIG. 5 depicts a high-level block diagram of a computer that can be transformed to into a machine that is dedicated to perform the functions described herein. As depicted in FIG. 5, the computer 500 comprises one or more hardware processor elements 502 (e.g., a central processing unit (CPU), a microprocessor, or a multi-core processor), a memory 504, e.g., random access memory (RAM) and/or read only memory (ROM), a module 505 for reducing contamination on a decurler in a printer, and various input/output devices 506 (e.g., storage devices, including but not limited to, a tape drive, a floppy drive, a hard disk drive or a compact disk drive, a receiver, a transmitter, a speaker, a display, a speech synthesizer, an output port, an input port and a user input device (such as a keyboard, a keypad, a mouse, a microphone and the like)). Although only one processor element is shown, it should be noted that the computer may employ a plurality of processor elements. Furthermore, although only one computer is shown in the figure, if the method(s) as discussed above is implemented in a distributed or parallel manner for a particular illustrative example, i.e., the steps of the above method(s) or the entire method(s) are implemented across multiple or parallel computers, then the computer of this figure is intended to represent each of those multiple computers. Furthermore, one or more hardware processors can be utilized in supporting a virtualized or shared computing environment. The virtualized computing environment may support one or more virtual machines representing computers, servers, or other computing devices. In such virtualized virtual machines, hardware components such as hardware processors and computer-readable storage devices may be virtualized or logically represented.

It should be noted that the present disclosure can be implemented in software and/or in a combination of software and hardware, e.g., using application specific integrated circuits (ASIC), a programmable logic array (PLA), including a field-programmable gate array (FPGA), or a state machine deployed on a hardware device, a computer or any other hardware equivalents, e.g., computer readable instructions pertaining to the method(s) discussed above can be used to configure a hardware processor to perform the steps, functions and/or operations of the above disclosed methods. In one embodiment, instructions and data for the present module or process 505 for reducing contamination on a decurler in a printer (e.g., a software program comprising computer-executable instructions) can be loaded into memory 504 and executed by hardware processor element 502 to implement the steps, functions or operations as discussed above in connection with the exemplary method 400. Furthermore, when a hardware processor executes instructions to perform "operations," this could include the hardware processor performing the operations directly and/or facilitating, directing, or cooperating with another hardware device or component (e.g., a co-processor and the like) to perform the operations.

The processor executing the computer readable or software instructions relating to the above described method(s) can be perceived as a programmed processor or a specialized processor. As such, the present module 505 for reducing contamination on a decurler in a printer (including associated data structures) of the present disclosure can be stored on a tangible or physical (broadly non-transitory) computer-readable storage device or medium, e.g., volatile memory, non-volatile memory, ROM memory, RAM memory, magnetic or optical drive, device or diskette and the like. More specifically, the computer-readable storage device may comprise any physical devices that provide the ability to store information such as data and/or instructions to be accessed by a processor or a computing device such as a computer or an application server.

It will be appreciated that variants of the above-disclosed and other features and functions, or alternatives thereof, may be combined into many other different systems or applications. Various presently unforeseen or unanticipated alternatives, modifications, variations, or improvements therein may be subsequently made by those skilled in the art which are also intended to be encompassed by the following claims.

What is claimed is:

1. A method for reducing contamination on a decurler in a printer, comprising:

printing, by a marking engine, an image on a paper on a first side;

inverting, by a first inverter, the paper so that the image on the first side is facing in an opposite direction than when passing through the marking engine; and decurling, by the decurler, the paper such that the image on the first side contacts a soft roller of an upstream decurler.

2. The method of claim 1, wherein the image is printed with a water based ink.

3. The method of claim 1, wherein the printing, by the marking engine, the image on the paper on the first side further comprises:

passing the paper through a registration module;

marking the paper with the image on the first side; and drying the image on the first side of the paper.

4. The method of claim 1, further comprising:

applying, by a pre-curler, an up curl to the paper before entering the marking engine.

5. The method of claim 1, further comprising:

moving the paper through one or more transport paths; and outputting the paper to a paper tray for a simplex path in an 1–N order.

6. The method of claim 1, further comprising:

moving the paper through one or more transport paths;

inverting, by a second inverter, the paper so that the image on the first side is facing in an original direction as when passing through the marking engine; and outputting the paper to a paper tray for simplex path in an N–1 order.

7. The method of claim 1, further comprising:

printing, by the marking engine, a second image on the paper on a second side for duplex printing before the paper enters the first inverter.

8. The method of claim 7, further comprising:

moving the paper through one or more transport paths; and outputting the paper to a paper tray for a duplex path for an 1–N order.

9. The method of claim 1, further comprising:

moving the paper through one or more transport paths;

inverting, by a second inverter, the paper so that the image on the first side is facing in an original direction as when passing through the marking engine; and outputting the paper to a paper tray for duplex path for an N–1 order.

10. A non-transitory computer readable medium for storing instructions, which when executed by a processor, perform operations for reducing contamination on a decurler in a printer, the operations comprising:

causing a marking engine to print an image on a paper on a first side;

causing a first inverter to invert the paper so that the image on the first side is facing in an opposite direction than when passing through the marking engine; and causing the decurler to decurl the paper such that the image on the first side contacts a soft roller of an upstream de-curler.

11. The non-transitory computer readable medium of claim 10, wherein the image is printed with a water based ink.

12. The non-transitory computer readable medium of claim 10, wherein the causing the marking engine to print the image on the paper on the first side further comprises:

causing the paper to pass through a registration module;

causing a marker to mark the paper with the image on the first side; and causing a dryer to dry the image on the first side of the paper.

13. The non-transitory computer readable medium of claim 10, further comprising:

causing a pre-curler to apply an up curl to the paper before entering the marking engine.

14. The non-transitory computer readable medium of claim 10, further comprising:

causing the paper to move through one or more transport paths; and causing the paper to be outputted to a paper tray for a simplex path in an 1–N order.

15. The non-transitory computer readable medium of claim 10, further comprising:

causing the paper to move through one or more transport paths;

causing a second inverter to invert the paper so that the image on the first side is facing in an original direction as when passing through the marking engine; and causing the paper to be outputted to a paper tray for simplex path for an N–1 order.

16. The non-transitory computer readable medium of claim 10, further comprising:

causing the marking engine to print a second image on the paper on a second side for duplex printing before the paper enters the first inverter.

17. The non-transitory computer readable medium of claim 16, further comprising:

causing the paper to move through one or more transport paths; and causing the paper to be outputted to a paper tray for a duplex path for an 1–N order.

18. The non-transitory computer readable medium of claim 16, further comprising:

causing the paper to move through one or more transport paths;

causing a second inverter to invert the paper so that the image on the first side is facing in an original direction as when passing through the marking engine; and causing the paper to be outputted to a paper tray for duplex path for an N–1 order.

19. An inkjet printer, comprising:

a marking path comprising a registration, a marker and a dryer;

a first transport path located after the marking path;

a pre-inverter located after the marking path and the first transport path to invert a paper so that a most recently printed image on a respective side of the paper is facing in an opposite direction than when passing through the marking engine;

a single decurler located after the pre-inverter comprising a rubber roller and a stainless steel roller, wherein the most recently printed image on the respective side of the paper contacts the rubber roller and does not contact the stainless steel roller;

at least one second transport path located after the single decurler; and a paper tray located after the at least one second transport path.

20. The inkjet printer of claim 19, further comprising:

a pre-curler located before the marking path to add an up curl to the paper before entering the marking path; and a post inverter located after the at least one second transport path and before the paper tray for outputting the paper to the paper tray in an N–1 order.

* * * * *